United States Patent [19]

Schertz

[11] 3,938,423

[45] Feb. 17, 1976

[54] RECOIL OPERATED FIREARM WITH UNITARY BARREL AND BREECH BOLT LOCK MEMBER

[75] Inventor: Charles J. Schertz, Bettendorf, Ill.

[73] Assignee: The United States of America as represented by the Secretary of the Army, Washington, D.C.

[22] Filed: June 6, 1974

[21] Appl. No.: 476,807

[52] U.S. Cl. ..... 89/176

[51] Int. Cl.[2] ..... F41D 1/02; F41D 3/00

[58] Field of Search ..... 89/176, 42 B, 154

[56] References Cited

UNITED STATES PATENTS 728,739 5/1903 Mannlicher ..... 89/176

*Primary Examiner*—Verlin R. Pendegrass
*Assistant Examiner*—Ralph Palo
*Attorney, Agent, or Firm*—Nathan Edelberg; Robert P. Gibson; Thomas R. Webb

[57] ABSTRACT

A short-recoil operated automatic firearm is provided with a single locking member for alternately (1) locking the breech bolt to the barrel while unlocking the barrel from the receiver, and (2) unlocking the breech bolt from the barrel while locking the barrel to the receiver. The locking member is a lever pivoted intermediate its ends on the barrel and comprising an arm engageable with an abutment (barrel buffer) on the receiver, an opposite arm having a notch engageable with a locking projection on the breech bolt, and an intermediate arm engageable by the bolt in its return movement to rotate the lever to bolt-locking (and barrel unlocking) position.

6 Claims, 8 Drawing Figures

RECOIL OPERATED FIREARM WITH UNITARY BARREL AND BREECH BOLT LOCK MEMBER

GOVERNMENTAL INTEREST

The invention described herein may be manufactured, used and licensed by or for the Government for governmental purposes without the payment to me of any royalty thereon.

BACKGROUND AND SUMMARY OF THE INVENTION

The present invention is an improvement in automatic firearms of the recoil-operated type wherein the various operations of extracting, ejecting, loading and cocking are performed by the energy of the barrel and breech bolt recoiling in the receiver on firing, and particularly, recoil-operated firearms of the short-recoil type. In short-recoil operated automatic firearms, the breech bolt is locked to the barrel at the instant of firing and remains locked along a relatively short recoil path, after which the breech bolt is automatically unlocked from the barrel, the barrel stops recoiling, and the breech bolt continues its recoil, extracting and ejecting the spent cartridge case. The barrel may be returned immediately, by a return spring or recoil buffer, to its forward or battery position, or may be held in its recoil position, by a barrel lock, until the breech bolt returns.

The breech bolt may be held near its fully recoiled position by a trigger sear, and/or an automatic sear that is released by the cartridge feed mechanism. The trigger sear is held retracted by the trigger during fully automatic firing. When the breech bolt is released from both sears, it is moved forwardly by its drive spring and pushes or rams a cartridge, e.g., from a belt, into the barrel chamber. At or about the point where the breech bolt engages the barrel, it is automatically locked to the barrel and, if the barrel has not yet returned to battery, the barrel lock is automatically released and the locked breech bolt and barrel return to battery position. Firing may occur automatically at any desired time after breech bolt locking, preferably during the barrel return in order to minimize the recoil action on the firearm mount.

The conventional short-recoil operated firearm has at least two separate locks, namely, at least one bolt lock and a barrel lock, which are critically timed. The timing of these locks is affected by excessive lock wear, and may be magnified by bolt-barrel bounce. When the timing is affected, the weapon functioning becomes erratic and may cease to operate, thus necessitating replacement of the locks as well as possible replacement of the lock operating cams.

In accordance with the present invention, the various bolt and barrel locks in a short-recoil operated automatic firearm are replaced by a single locking member comprising means for alternating locking the breech bolt and the barrel. In the embodiment illustrated as an example, the unitary bolt-barrel lock member is a lever pivoted intermediate its ends on the barrel, near the rear end thereof, and comprising a forward arm engageable with an abutment of the receiver, e.g., the barrel buffer, a rear arm having a hook portion engageable with a lateral projection on the breech bolt, and an intermediate arm engageable by the breech bolt in its forward motion to release the barrel lock from the receiver. The lock member is spring-pressed toward its barrel-locking position.

DETAILED DESCRIPTION OF A PREFERRED EMBODIMENT

Figure 1:
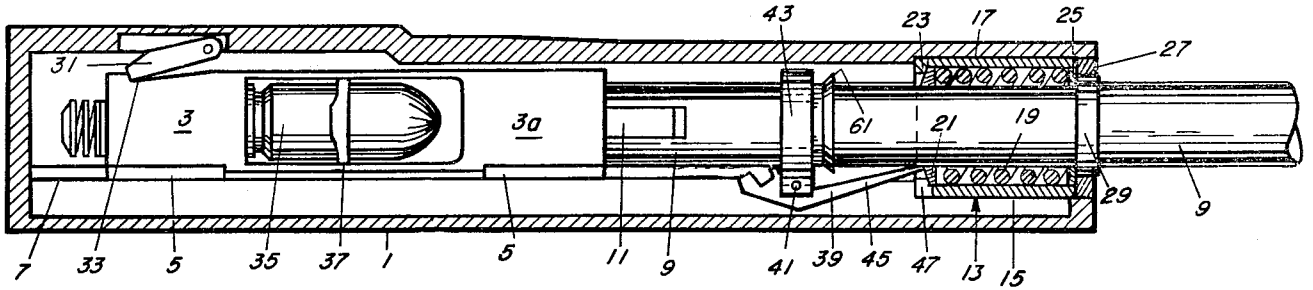
FIGS. 1 through 8 are right side views of a recoiling-barrel firearm embodying the invention, with the receiver shown in section, and showing the barrel and breech bolt in different positions relative to the receiver.

FIG. 1, for example, is a right side view of a recoil-operated automatic firearm embodying the invention, with a box-shaped receiver 1 cut-away in section to show a breech block or bolt 3 of generally rectangular cross section slidably mounted in the receiver 1 by means of two guide ribs 5 on each side of the bolt 3 which ride in grooves 7 (one shown) in the side walls of the receiver. A barrel 9 is slidably mounted in a forward tubular extension 3*a* of the breech bolt 3 by means of two guide ribs 11 (one shown) which ride in guide grooves (not shown) in extension 3*a*.

The barrel 9 extends through and is further guided by a barrel buffer 13 which comprises a hollow cylindrical housing 15 rigidly mounted in a mating recess 17 in the forward end of the receiver 1 and containing a buffer spring 19. The rear end of spring 19 abuts a rear ring 21 which is slidable in housing 15 and is retained by an inwardly-extending flange 23 on housing 15. The front end of spring 19 abuts a front ring 25 which is also slidable in housing 15 and is retained by a nut 27 threaded into housing 15. On recoil, a nut or ring 29 on the barrel engages the front ring 25 to compress the spring 19 and absorb most of the residual recoil energy of the barrel.

Figure 4:
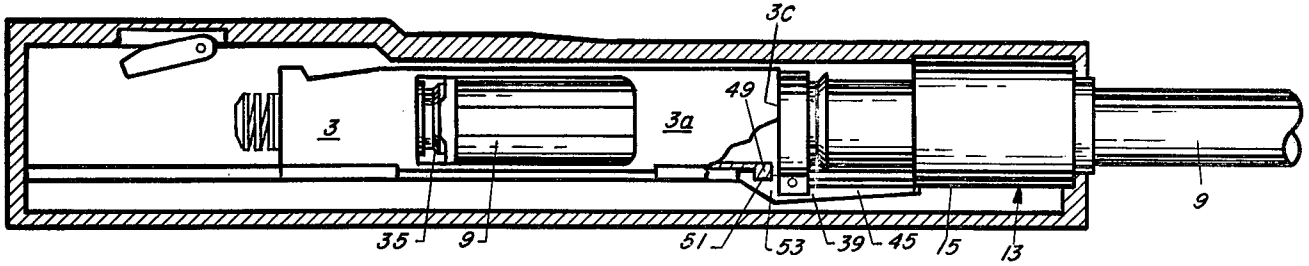

FIG. 1 shows the bolt 3 held in a rearward position by a sear 31 pivoted on the receiver and engaging the rear wall of a notch 33 in the upper surface of the bolt 3. When released from the sear 31, the bolt 3 will be moved forward by its drive spring (not shown) to transfer a live cartridge from a belt having links 37 into the barrel chamber (not shown) located within the extension 3*a* in FIG. 1. The barrel 9 is shown in recoil position, where it is prevented from moving forwardly by a lock member 39. Lock member 39 is a lever pivoted at 41 intermediate its two ends on a downwardly-extending portion of a band 43 integral with or attached to the barrel 9 in a region spaced rearwardly from the buffer 13. A forwardly-extending arm 45 of member 39 abuts the rear face of rear ring 21 of the buffer, which rear face is inclined at an angle substantially normal to the arm 45. A portion 47 of the flange 23 of housing 15 is cut away to provide clearance for the arm 45 to move to barrel-unlocking position (FIGS. 4 and 5).

Figure 2:
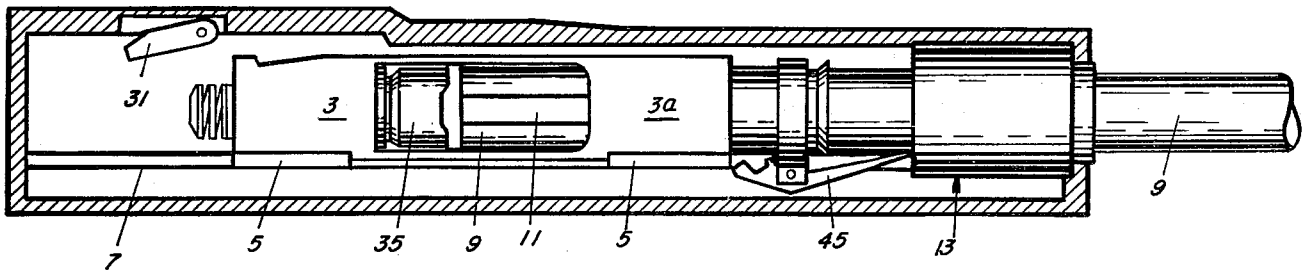

The present invention is an improvement over an experimental 40mm automatic grenade launcher, XM175, having two automatic bolt locks and a separate barrel lock, with the remainder of the receiver, breech bolt and barrel structure the same as that shown in FIG. 1–8. In the XM175 firearm, the sear 31 is an automatic sear which, when engaged by the bolt notch 33, moves forwardly slightly and initiates the cartridge feed mechanism. The feed mechanism then advances the next cartridge 35 in front of the bolt 3, as shown in FIG. 1, and the cartridge 35 pushes or ejects the spent case 35*a* through the ejection slot 3*b* in the bolt 3 (see FIG. 8). At or near the completion of the cartridge feeding operation, the feed mechanism automatically releases the sear 31, allowing the bolt 3 to start forward as shown in FIG. 2. The cartridge feed mechanism and associated control linkages with the sear 31 have not been shown, because they do not form a necessary part of present invention.

Figure 3:
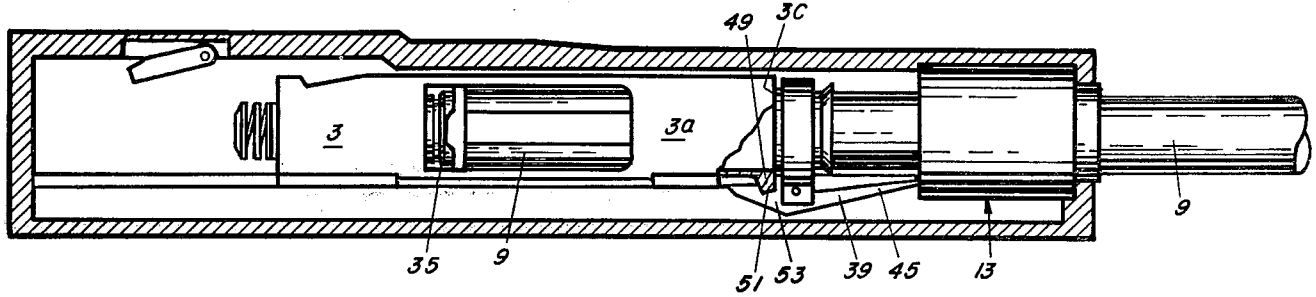

FIG. 3 shows the barrel 9 still locked in recoil position by lock member 39, and the breech bolt 3 with the forward edge *3c* of extention *3a* almost in contact with the barrel band 43. The bolt extension *3a* is shown partially cut away in FIGS. 3–5 to show a downwardly-extending locking projection 49 thereon designed to interfit with an upwardly-facing hook or notch 51 on a rearwardly-extending arm 53 of locking member 39. The locking member 39 is biased counterclockwise toward barrel-locking (and bolt-unlocking) position by a coil spring 55 disposed in a recess 57 in band 43 and engaging an intermediate upstanding arm 59 on member 39 (FIG 5). In FIG. 3, the forward end of projection 49 has just contacted the arm 59 and is beginning to pivot the lever 39 clockwise, toward barrel-releasing position. FIG. 4 shows the parts an instant later in a position wherein the bolt edge *3c* abuts the barrel 9, the bolt is positively locked to the barrel (by lock arm 53 engaging bolt projection 49), the lock arm 45 is disengaged from the buffer 13, and the barrel has started to return to battery position.

Figure 5:
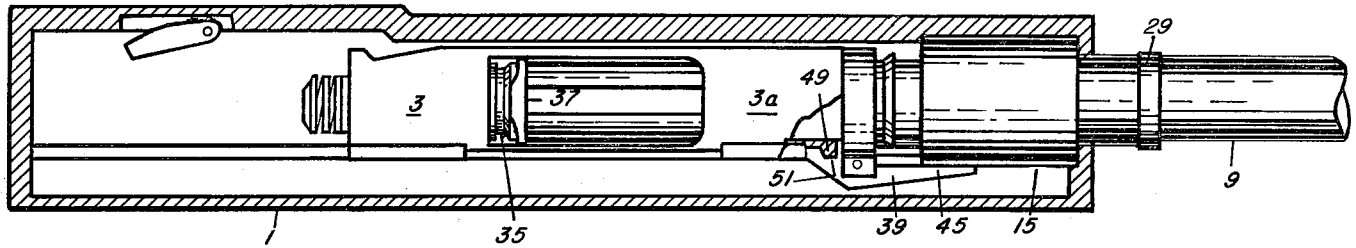

FIG. 5 shows the locked bolt 3 and barrel 9 in firing position, preferably during the return motion. The cartridge may be fired by any conventional means, such as a firing pin and an actuating lever in the bolt automatically actuated by an abutment on the receiver, during the final return movement of the bolt. If firing should not occur, the barrel would continue its forward motion until stopped by a stop band 61 engaging the rear ring 21 of the buffer 13 (FIG. 1). During the entire return motion of the barrel and most of the subsequent recoil, the locking lever 39 is locked in bolt-locking position by the buffer housing 15, which prevents upward movement of arm 45.

Figure 6:
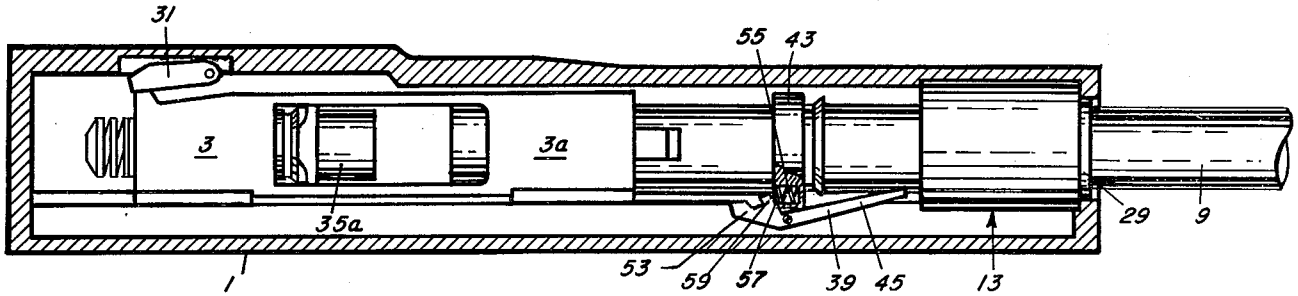
Figure 7:
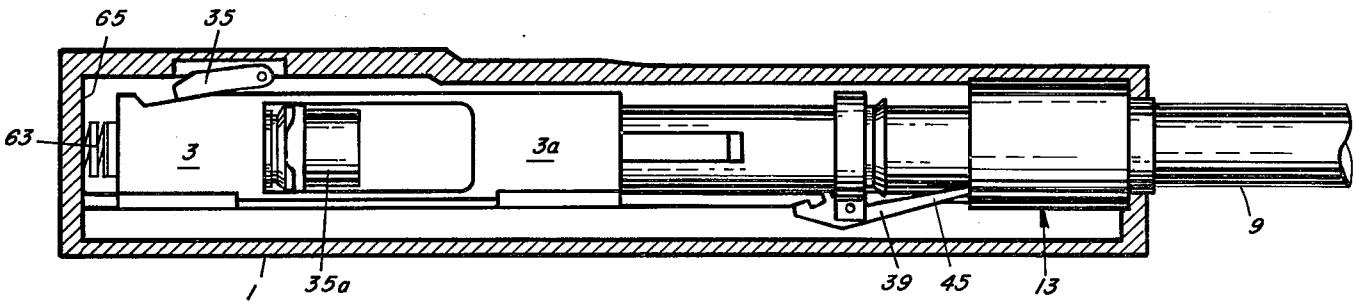

After firing, the barrel 9 (while locked to the bolt 3) recoils to the position shown in FIG. 6, where it is stopped by engagement of the barrel nut 29 with the front ring 25 of buffer 13 and compression of spring 19 (FIG 1). Just prior to this full-recoil position, the lock arm 45 is freed from buffer housing 15, and the lock member 39 is pivoted counterclockwise to bolt-unlocking and barrel-locking position by the spring 55 and the chamber pressure urging the bolt 3 to separate from the barrel 9. The locking surfaces of projection 49 and notch 51 are inclined to facilitate unlocking of the bolt 3. When unlocked, the bolt 3 continues to recoil to the full-recoil position shown in FIG. 7, where it is stopped by engagement of a spring buffer 63 thereon with a rear wall 65 of the receiver 1. During this continued recoil, the breech bolt extracts the spent case *35a* from the chamber. Meanwhile, the buffer spring 19 returns the barrel 9 a short distance until stopped by arm 45 of the lock member 39.

Figure 8:
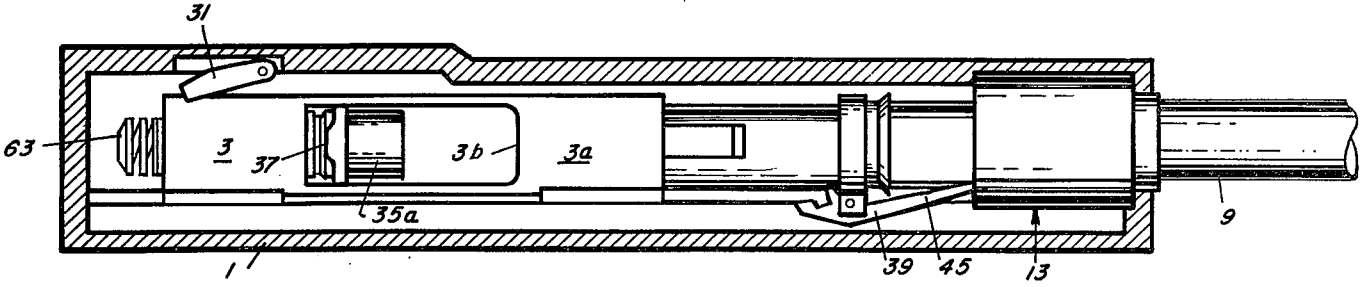

After recoil, the bolt 3 is returned by its drive spring and the buffer spring 65 to the position shown in FIG. 8 (and FIG. 1) where it is held by sear 31. Then, the cycle of loading, bolt-locking, barrel-unlocking, firing, recoil, bolt-unlocking, barrel-locking, extraction and ejection is repeated, as described above.

It will be understood that the sear 31 may be a trigger-operated sear, and the described (but not illustrated) interlocks between the sear and the cartridge feed mechanism may be omitted. Any suitable conventional cartridge feed mechanism may be used. Moreover, the barrel lock arm 45 may engage some fixed abutment in the receiver other than the barrel buffer. The various parts of the firearm may be made of any suitable metals or alloys, as is well known in the art.

What is claimed is:

1. A short-recoil-operated automatic firearm comprising:

a receiver or frame;

a barrel slidably mounted on said receiver for reciprocation between a forward position and a rearward position;

a breech bolt slidably mounted on said receiver for reciprocation between a forward position, a rearward ejecting and loading position, and an intermediate position; and a single lock element mounted on said barrel and alternately engageable with portions of said breech bolt and said receiver for (1) locking said breech bolt to said barrel in said forward positions while permitting the locked barrel and breech bolt to recoil on firing, and (2) locking said barrel to said receiver in said rearward barrel position while releasing said breech bolt to continue its recoil motion; said single lock element being a lever pivoted intermediate its ends on said barrel and comprising a forward end engageable with a rearwardly-facing abutment on said receiver and a rear end with a lateral locking notch engageable with a complemental lateral locking projection on said breech bolt.

2. A firearm as in claim 1, wherein said lock element and said receiver include means for maintaining said lock element in breech bolt locking position during and after firing until just before said barrel reaches said rearward position.

3. A firearm as in claim 2, wherein said maintaining means comprises a surface on said lock element which engages an outer surface on said receiver when said lock element is in breech bolt-locking position, said outer surface being elongated and parallel to the path of said barrel.

4. A firearm as in claim 3, wherein said abutment on said receiver is the rear end of a cylindrical barrel recoil buffer, and said outer surface is the outer surface of said buffer.

5. A firearm as in claim 1, wherein said lever further comprises a transverse arm intermediate the ends thereof which is engaged by the forwardly-moving breech bolt to pivot said lock element to barrel-releasing position.

6. A short-recoil-operated atutomatic firearm comprising:

a receiver or frame;

a barrel slidably mounted on said receiver for reciprocation between a forward position and a rearward position;

a breech bolt slidably mounted on said receiver for reciprocation between a forward position, a rearward ejecting and loading position, and an intermediate position; and a single lock element mounted on said barrel and alternately engageable with portions of said breech bolt and said receiver for (1) locking said breech bolt to said barrel in said forward positions while permitting the locked barrel and breech bolt to recoil on firing, and (2) locking said barrel to said receiver in said rearward barrel position while releasing said breech bolt to continue its recoil motion;

a spring biasing said lock element toward barrel-locking position independent of the motions of said breech bolt and barrel; and means on said lock element actuated by the forward-moving breech bolt near said intermediate position for moving said lock element to barrel-releasing position.

* * * * *